United States Patent [19]

Alexander, III

[11] Patent Number: 4,574,845

[45] Date of Patent: Mar. 11, 1986

[54] CLOTH ROLL OVERHEAD TAKEUP APPARATUS AND METHOD

[76] Inventor: William J. Alexander, III, 41 W. Golden Strip Dr., Mauldin, S.C. 29662

[21] Appl. No.: 724,022

[22] Filed: Apr. 17, 1985

Related U.S. Application Data

[62] Division of Ser. No. 454,702, Dec. 30, 1982, abandoned.

[51] Int. Cl.[4] ..... D03J 1/00

[52] U.S. Cl. ..... 139/1 R; 139/304; 242/35.5 A; 242/79; 414/911

[58] Field of Search ..... 139/1 R, 304, 309, 311; 242/35.5 A, 79, 58.6; 414/910, 911

[56] References Cited

U.S. PATENT DOCUMENTS

| | | | |
|---|---|---|---|
| 1,396,980 | 11/1921 | Thornber | 414/911 |
| 1,736,016 | 11/1929 | Rosener | 414/911 |
| 3,164,332 | 1/1965 | Walker et al. | 139/309 |
| 3,690,583 | 9/1972 | Herman | 242/79 |
| 3,858,817 | 1/1975 | Riekkinen | 242/79 |
| 3,865,151 | 2/1975 | Poole | 139/304 |
| 3,884,271 | 5/1975 | Bond et al. | 139/1 R |
| 4,131,206 | 12/1978 | Kawada et al. | 242/79 |
| 4,146,190 | 3/1979 | Bond et al. | 139/311 |

*Primary Examiner*—Henry S. Jaudon
*Attorney, Agent, or Firm*—Bailey & Hardaway

[57] ABSTRACT

An overhead loom takeup is illustrated having a first downward run of cloth wherein the cloth is moved thence upwardly and over a guide roll prior to being moved generally longitudinally over compensator means to a surface wound roll positioned generally above the warp beam. Doffing means are provided overhead of the beams in the aisles between adjacent warp beams and include rail carried transport means.

3 Claims, 5 Drawing Figures

CLOTH ROLL OVERHEAD TAKEUP APPARATUS AND METHOD

This application is a division of application Ser. No. 454,702 filed Dec. 30, 1982, now abandoned.

BACKGROUND OF THE INVENTION

The prior art is best illustrated in U.S. Pat. Nos. 3,707,995 and 3,865,151. Both of these patents show the use of overhead surface wound cloth roll takeups, each of which employ overhead rolls positioned toward the rear of the loom substantially above the warp beam. U.S. Pat. No. 3,865,151 shows the cloth passing upwardly directly from the sand roll to a guide roll and thence upon a substantially horizontal run rearwardly to a center wound cloth roll. This apparatus possesses the significant disadvantage of limiting access to the front portion of the loom, as well as offering a limited inspection area.

Therefore, an important object of this invention is to procure the advantages of a bigger roll as permitted by off-the-loom takeups, together with the advantages of a surface wound takeup above the loom while permitting access to the front portions of the loom and offering greater area for inspection of the woven fabric. Moreover, access may be had within the fabric between the fabric and the front of the loom by utilizing a walkway which may be pivoted downwardly spreading the upward run of the cloth to permit access between it and the loom. Other United States Letters Patents which illustrate overhead cloth roll takeups include U.S. Pat. Nos. 3,884,271 and 3,911,966.

SUMMARY OF THE INVENTION

It has been found that an improved overhead loom takeup forming a cloth roll above a loom may be provided utilizing a first transverse guide roll adjacent a lower front portion of the loom for receiving a downward run of cloth on the loom, together with a second transverse guide roll above the loom receiving an upward run of cloth from the first transverse roll while providing a generally horizontal run of cloth extending from the second guide roll rearwardly to the takeup roll over a compensator roll carried by pivoted arms. A suitable compensator roll is illustrated in U.S. Pat. No. 4,216,804, the disclosure of which is incorporated herein by reference. It has also been found that doffing may advantageously be accomplished by positioning a track and cart above the loom in the aisle between adjacent such loom beams for receiving the full loom beams.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
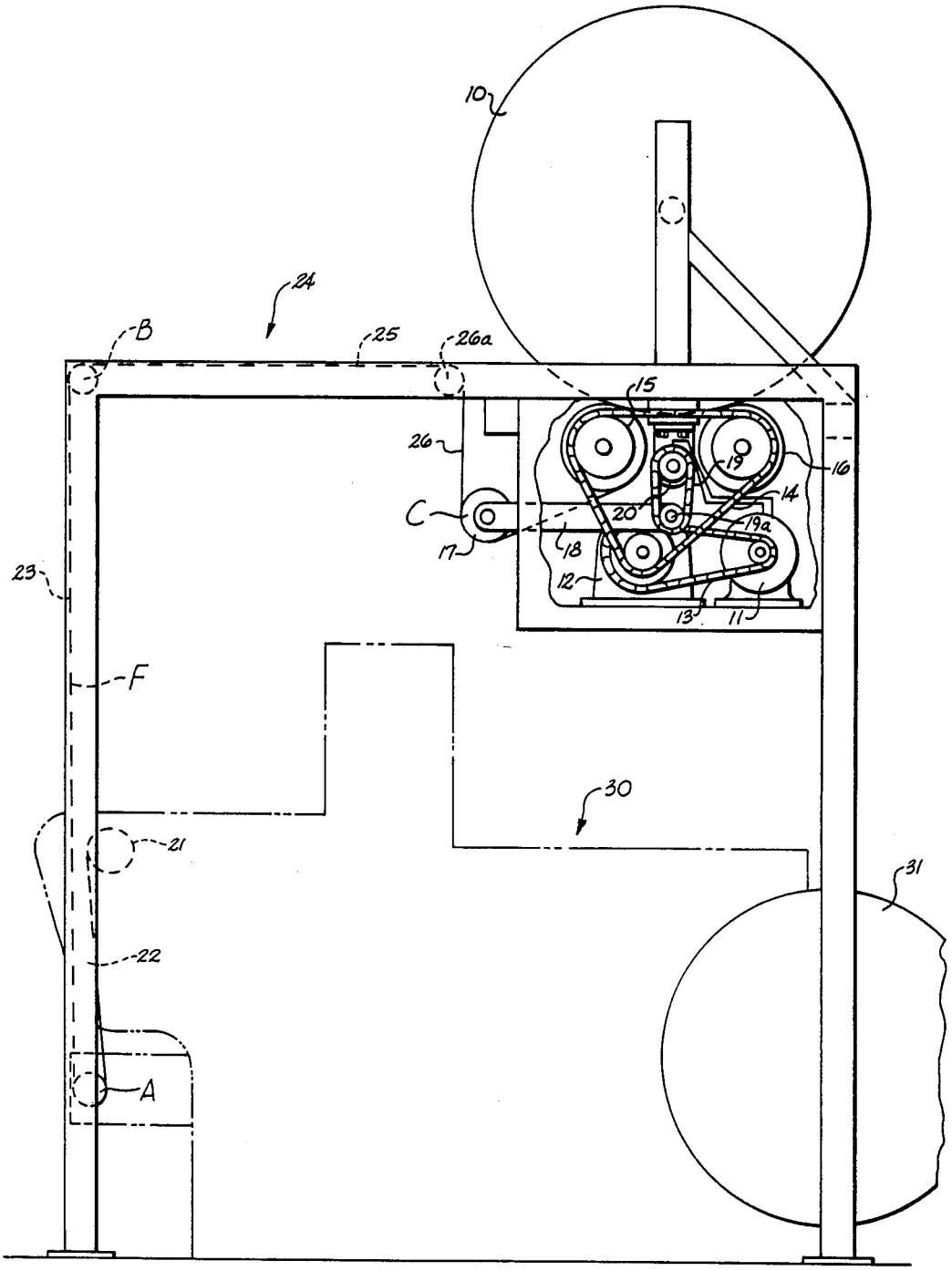
FIG. 1 is a side elevation illustrating a loom having an overhead takeup means constructed in accordance with the invention.

The drawings illustrate an overhead loom takeup having a pair of spaced transverse driven rolls supporting a cloth roll above a loom. A first transverse guide means A is carried adjacent a front portion of the loom receiving a downward run of cloth woven on the loom. A second transverse guide means B is positioned above the loom receiving an upward run of said cloth from the first transverse guide means. Means C forms a longitudinal run of cloth extending from the second transverse guide means to the transverse driven rolls and includes a transverse compensator means controlling the tension in the longitudinal run of the cloth between second transverse guide means and the transverse driven rolls. A doffing and transporting means D is also positioned above the looms in an aisle between adjacent looms.

The cloth roll is illustrated at 10 as being carried on a pair of surface wound rolls and the drive includes a motor 11 which drives a gear reducer 12 through a chain 13. The gearbox in turn drives a chain 14 which drives a pair of transverse bed rolls 15 and 16.

A compensator C includes an oscillator roll 17 which is carried between pivoted arms 18. The arms through oscillatory movement drive a chain 19 carried by a sprocket on a shaft 19*a* which serves as the pivot point for the arms which in turn drives a suitable control mechanism such as a variable transformer 20 for driving the motor 11 at a responsive and desirable speed. The fabric or cloth which passes over the sand roll 21 moves first downwardly on a run beneath the roll A as indicated at 22 and thence upwardly in an upper run 23 over a guide roll B carried in the upper left hand corner of a substantially rectangular frame broadly designated at 24. The cloth then passes on a rearward substantially horizontal run 25 which includes a downward coarse 26 over the transverse aligned roll 26*a* around the compensator roll 17 and thence beneath the roll 15 to the cloth roll. The looms are broadly designated at 30 and each loom includes a warp beam at the rear portion indicated at 31.

Figure 2:
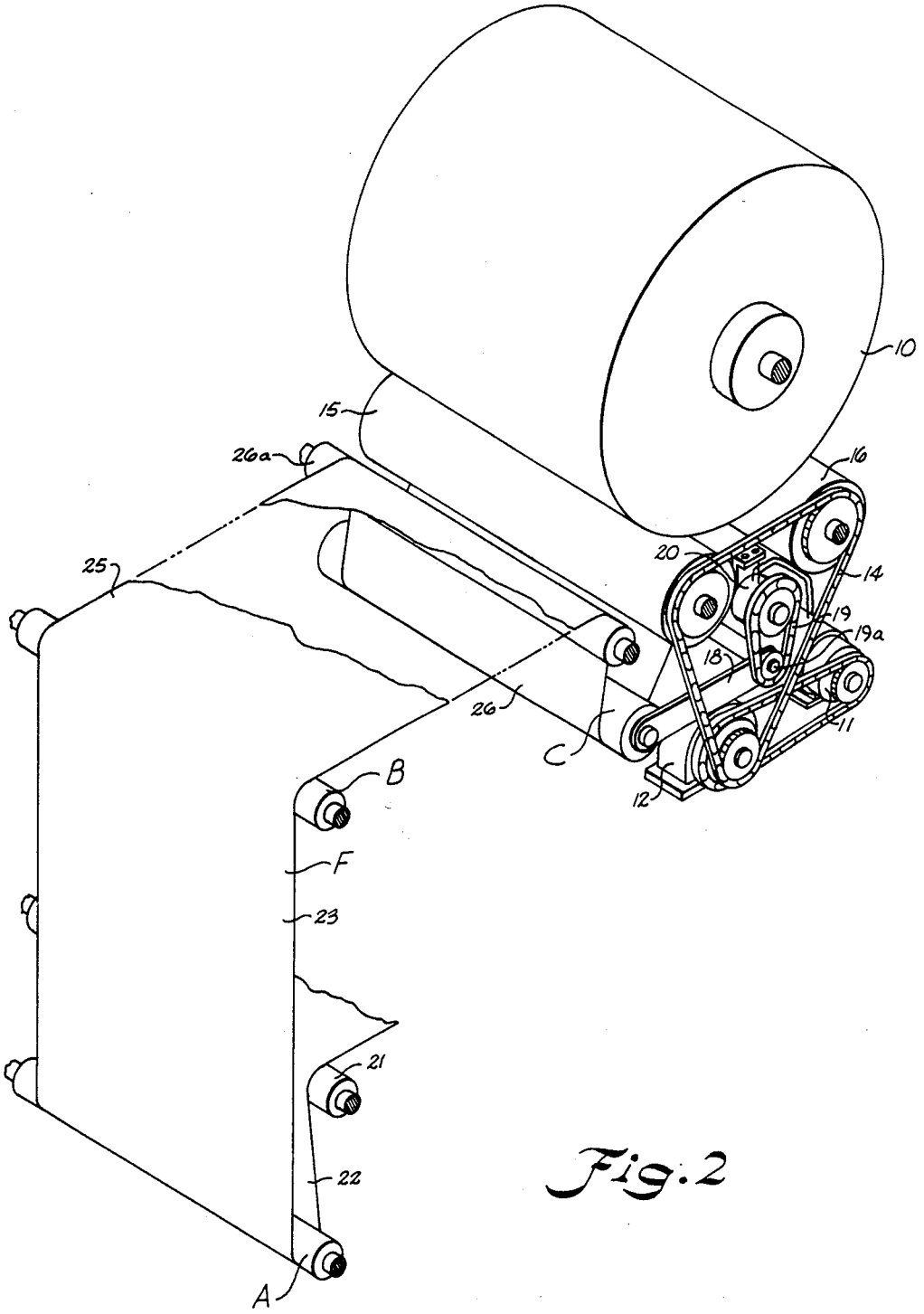
FIG. 2 is a perspective view illustrating the cloth path and takeup apparatus for an overhead takeup constructed in accordance with the present invention.
Figure 3:
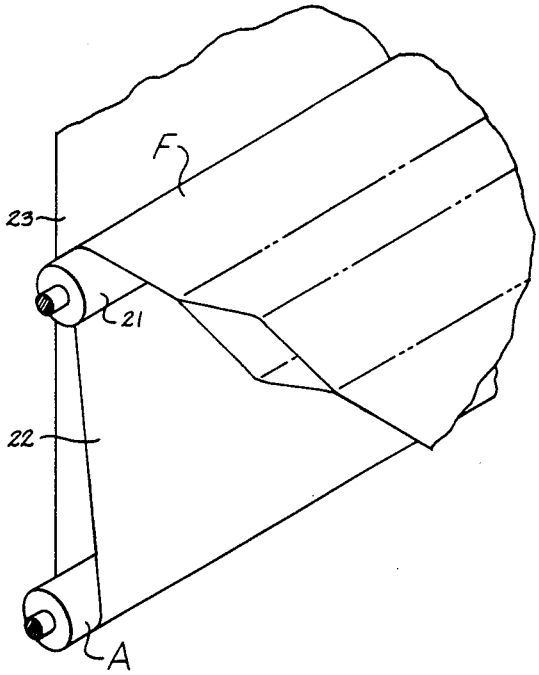
FIG. 3 is a perspective view looking toward the right hand rear portion of FIG. 1 illustrating the cloth path and lower guide roll.
Figure 4:
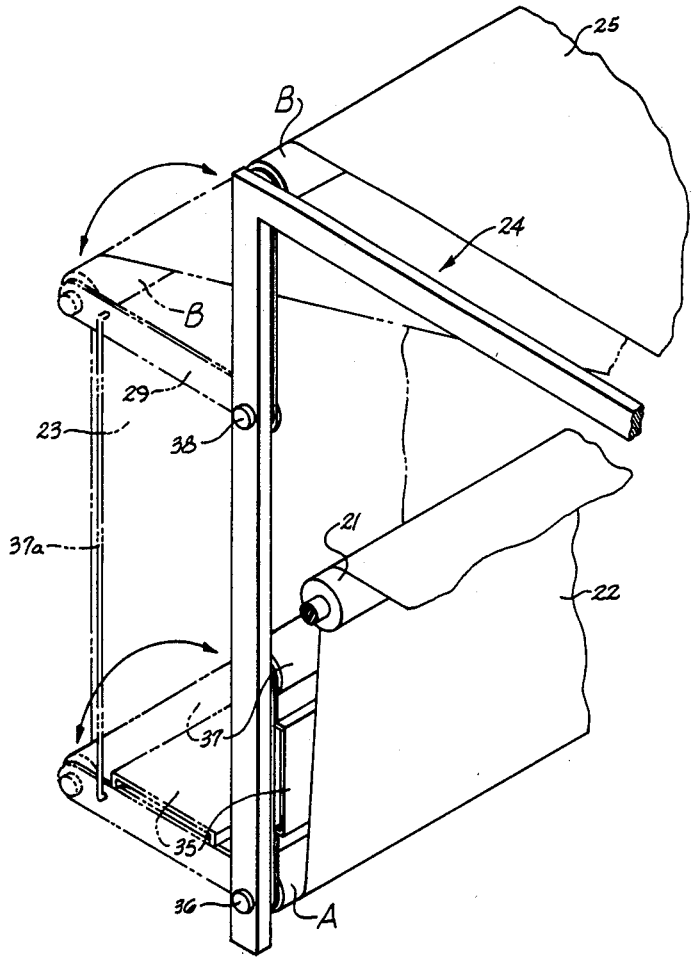
FIG. 4 is a perspective view similar to FIG. 3 illustrating a modified form of the invention wherein rolls are provided for pivoting downwardly for creating additional space between the upward cloth run and the loom to accommodate an operator.
Figure 5:
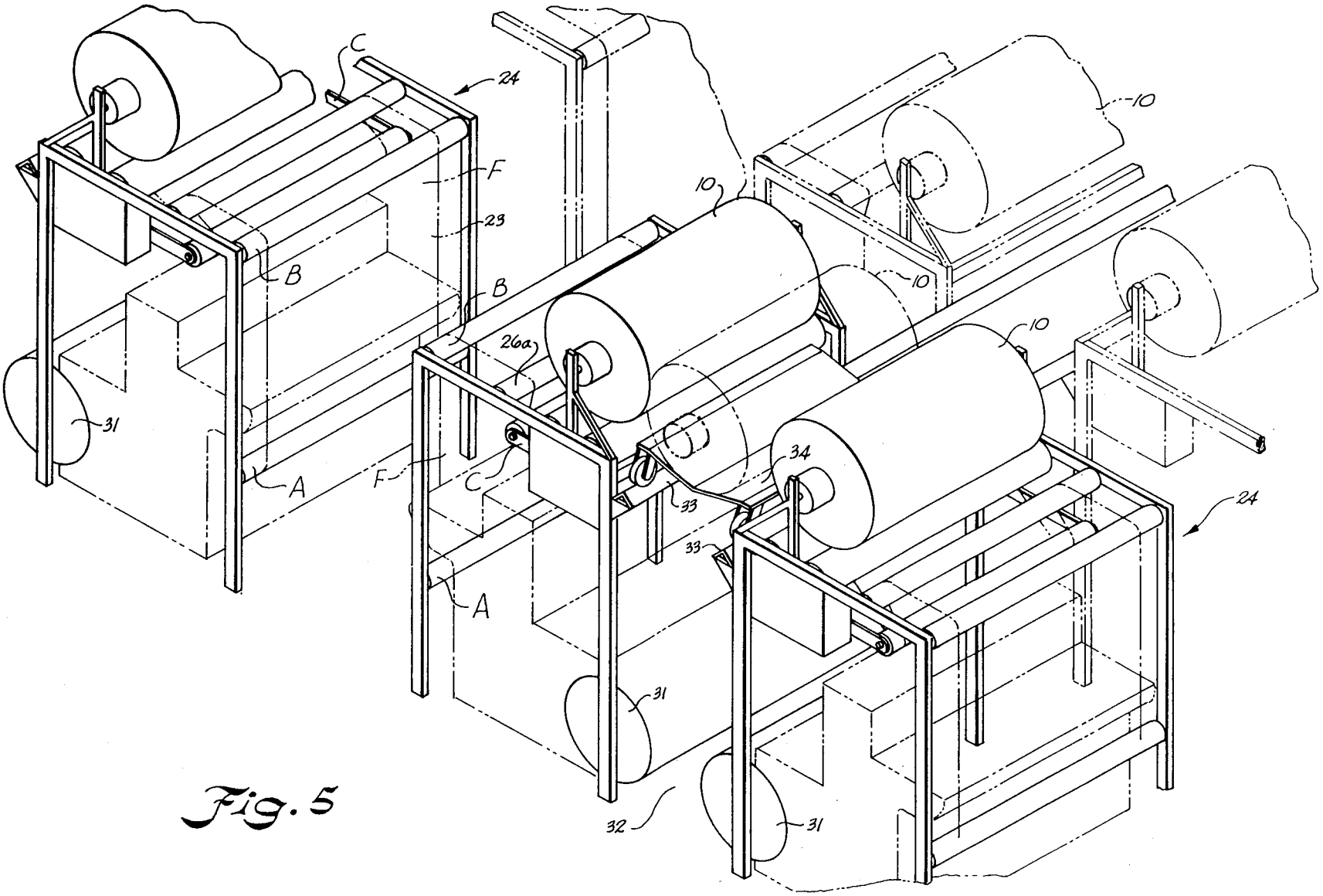
FIG. 5 is a perspective view illustrating a number of looms equipped in accordance with the invention illustrating a doffing apparatus located above the loom in the aisle between adjacent looms.

FIG. 3 further illustrates the cloth path shown in FIGS. 1, 2 and 5, while FIG. 4 illustrates a modified form of the invention wherein a work platform 35 is pivoted at 36 on the axis of the lower guide roll A. A roll 37 is provided positioned above the platform 35 for downward pivoting therewith for moving the vertical cloth run 23 outwardly providing a space at the front of the loom for worker access on the platform. The roll B is pivoted at 38 on the arms 39 to assist in so spreading the cloth. The respective arms which support the rolls B and 37 are connected by a rod 37*a*.

Referring more particularly to FIG. 5, an aisle 32 is formed between adjacent warp beams 31 and above the looms and in the aisle a pair of opposed rail members 33 are positioned for carrying a wheeled cart 34 therebetween. The cart is suitably shaped for receiving cloth rolls 10 thereon during doffing.

While a preferred embodiment of the invention has been described using specific terms, such description is for illustrative purposes only and it is to be understood that changes and variations may be made without departing from the spirit or scope of the following claims.

I claim:

1. An overhead loom takeup assembly comprising:

a plurality of looms having an aisle extending along adjacent warp beams;

a pair of spaced transverse driven rolls supporting a cloth roll above each loom;

a transverse guide means above said looms receiving an upward run of said cloth from said looms;

means forming a run of said cloth extending from said transverse guide means to said transverse driven rolls;

opposed tracks carried by adjacent looms extending along respective aisles above said looms; and a cart carried by said rails for receiving said cloth rolls upon doffing.

2. An overhead loom takeup assembly comprising:

a plurality of looms having an aisle extending along adjacent warp beams;

a pair of spaced transverse driven rolls supporting a cloth roll above each loom;

a first transverse guide means carried adjacent a front portion of the looms receiving a downward run of cloth woven on the looms;

a second transverse guide means above said looms receiving an upward run of said cloth from said first transverse guide means;

means forming a longitudinal run of said cloth extending from said second transverse guide means to said transverse driven rolls;

opposed tracks carried by adjacent looms extending along respective aisles above said looms; and a cart carried by said rails for receiving said cloth rolls upon doffing.

3. The method of forming and doffing a cloth roll above a loom comprising the steps of:

positioning a surface wound cloth roll takeup above a loom;

guiding said cloth on an upward run in respect of said loom;

then guiding said cloth on a run to said surface wound cloth roll takeup; and doffing said cloth roll upon a cart movable above said looms down an aisle between adjacent looms.

* * * * *